US009082357B2

(12) United States Patent
Nakagawa et al.

(10) Patent No.: US 9,082,357 B2
(45) Date of Patent: Jul. 14, 2015

(54) LCD DISPLAY WITH PIXELS HAVING RGBW SUB-PIXELS AND WHERE POWER CONSUMPTION IS REDUCED BY USING A POLARITY INVERSION PATTERN IN WHICH ALL RED SUB-PIXELS IN A COLUMN HAVE THE SAME POLARITY

(75) Inventors: Teruhisa Nakagawa, Chiba (JP); Yoshinori Aono, Ibaraki (JP); Masahiro Ishii, Chiba (JP)

(73) Assignee: PANASONIC LIQUID CRYSTAL DISPLAY CO. LTD, Hyogo (JP)

( * ) Notice: Subject to any disclaimer, the term of this patent is extended or adjusted under 35 U.S.C. 154(b) by 333 days.

(21) Appl. No.: 13/549,208

(22) Filed: Jul. 13, 2012

(65) Prior Publication Data

US 2013/0016137 A1 Jan. 17, 2013

(30) Foreign Application Priority Data

Jul. 13, 2011 (JP) ..... 2011-155134

(51) Int. Cl.
*G09G 3/36* (2006.01)

(52) U.S. Cl.
CPC ..... *G09G 3/3614* (2013.01); *G09G 2300/0426* (2013.01); *G09G 2300/0452* (2013.01); *G09G 2320/0247* (2013.01)

(58) Field of Classification Search
CPC . G09G 3/3614; G09G 3/2074; G09G 3/3607; G09G 3/364; G09G 2300/0426; G09G 2300/0452; G09G 2300/0823; G09G 2320/0204; G09G 2320/0247
See application file for complete search history.

(56) References Cited

U.S. PATENT DOCUMENTS

| | | | | |
|---|---|---|---|---|
| 2006/0202927 | A1* | 9/2006 | Lee | 345/88 |
| 2007/0064190 | A1* | 3/2007 | Kim | 349/142 |
| 2007/0146518 | A1* | 6/2007 | Hong et al. | 348/308 |
| 2008/0150862 | A1* | 6/2008 | Tseng | 345/88 |
| 2009/0040243 | A1* | 2/2009 | Hisada et al. | 345/690 |
| 2010/0085293 | A1* | 4/2010 | Lee et al. | 345/94 |
| 2011/0156992 | A1* | 6/2011 | Moon et al. | 345/84 |
| 2012/0098871 | A1* | 4/2012 | Park et al. | 345/690 |
| 2012/0268476 | A1* | 10/2012 | Park | 345/589 |

FOREIGN PATENT DOCUMENTS

JP 11-295717 A 10/1999

* cited by examiner

*Primary Examiner* — Chanh Nguyen
*Assistant Examiner* — Navin Lingaraju
(74) *Attorney, Agent, or Firm* — McDermott Will & Emery LLP

(57) ABSTRACT

Each image signal line S is connected alternately to a plurality of sub-pixels P positioned on one side of the image signal line S and a plurality of sub-pixels P positioned on the other side. During one frame period, image signals having either one of the positive and negative polarities are input to the first, third, fourth, and sixth image signal lines S1, S3, S4, and S6 of the eight image signal lines S1 to S8 that constitute a unit array of the image signal lines during one frame period, while image signals having the other polarity are input to the remaining image signal lines S2, S5, S7, and S8. According to this liquid crystal display device, it is possible to prevent flicker in image and to prevent the common electrode position from becoming different from the base potential, while preventing increase of power consumption.

1 Claim, 7 Drawing Sheets

| | S1 | S2 | S3 | S4 | S5 | S6 | S7 | S8 |
|---|---|---|---|---|---|---|---|---|
| EVEN-NUMBER FRAME PERIOD | + | − | + | + | − | + | − | − |

| | S1 | S2 | S3 | S4 | S5 | S6 | S7 | S8 |
|---|---|---|---|---|---|---|---|---|
| ODD-NUMBER FRAME PERIOD | − | + | − | − | + | − | + | + |

FIG.5

| | S8n−1 | S1n | S2n | S3n | S4n | S5n | S6n | S7n | S8n | S1n+1 |
|---|---|---|---|---|---|---|---|---|---|---|
| | WHITE PIXEL ARRAY | RED PIXEL ARRAY | GREEN PIXEL ARRAY | BLUE PIXEL ARRAY | WHITE PIXEL ARRAY | RED PIXEL ARRAY | GREEN PIXEL ARRAY | BLUE PIXEL ARRAY | WHITE PIXEL ARRAY | RED PIXEL ARRAY |
| Gn | − | + | − | + | + | − | + | − | − | |
| Gn+1 | + | − | + | + | − | + | − | − | + | |
| Gn+2 | − | + | − | + | + | − | + | − | − | |
| Gn+3 | + | − | + | + | − | + | − | − | + | |
| Gn+4 | | | | | | | | | | |

FIG.8

| | S8n−1 | S1n | S2n | S3n | S4n | S5n | S6n | S7n | S8n | S1n+1 |
|---|---|---|---|---|---|---|---|---|---|---|
| | GREEN PIXEL ARRAY | BLUE PIXEL ARRAY | WHITE PIXEL ARRAY | RED PIXEL ARRAY | GREEN PIXEL ARRAY | BLUE PIXEL ARRAY | WHITE PIXEL ARRAY | RED PIXEL ARRAY | GREEN PIXEL ARRAY | |
| Gn | − | + | − | + | + | − | + | − | − | |
| Gn+1 | + | − | + | + | − | + | − | − | + | |
| Gn+2 | − | + | − | + | + | − | + | − | − | |
| Gn+3 | + | − | + | + | − | + | − | − | + | |
| Gn+4 | | | | | | | | | | |

LCD DISPLAY WITH PIXELS HAVING RGBW SUB-PIXELS AND WHERE POWER CONSUMPTION IS REDUCED BY USING A POLARITY INVERSION PATTERN IN WHICH ALL RED SUB-PIXELS IN A COLUMN HAVE THE SAME POLARITY

CROSS-REFERENCE TO RELATED APPLICATION

The present application claims priority from Japanese application JP2011-155134 filed on Jul. 13, 2011, the content of which is hereby incorporated by reference into this application.

TECHNICAL FIELD

The present application relates to a liquid crystal display device having a liquid crystal panel including four sub-pixels in each pixel.

BACKGROUND

Many liquid crystal display devices performs frame reversal (frame inversion) driving which reverses the polarities of image signals to be respectively output to pixels for every frame of image. Some of the conventional liquid crystal display devices having a liquid crystal display panel including three sub-pixels of three colors, namely, red, blue, and green, in each pixel performs dot inversion driving which reverses the polarities of image signals for every sub-pixel. The dot inversion driving prevents flicker in image and prevents a common electrode potential from becoming different from a base potential.

Japanese Patent Laid-open Publication No. 1999-295717 discloses a liquid crystal display panel including a white sub-pixel in addition to the three sub-pixels of red, blue, and green in each pixel. According to such a display panel, it is possible to improve brightness of a displayed image.

SUMMARY

Dot inversion driving results in increased power consumption due to high inversion frequency of the polarity of an image signal. In the liquid crystal display panel including four sub-pixels in each pixel, the above high inversion frequency becomes a problem due to the increase of the number of sub-pixels.

An object of an embodiment of the present application is to prevent flicker and to prevent a common electrode potential from becoming different from abase potential, while preventing increase of power consumption, in a liquid crystal display device including a liquid crystal display panel having four sub-pixels of different colors in each pixel.

In one general aspect, the instant application describes a liquid crystal display device that includes a plurality of scan lines and a plurality of image signal lines formed thereon in a matrix, and a plurality of pixels each including a plurality of sub-pixels. Each of the sub-pixels is formed in an area defined by two adjacent image signal lines and two adjacent scan lines. The drive circuit outputs an image signal to the plurality of image signal lines in a frame reversal driving mode. The plurality of image signal lines are aligned in a first direction. Each of the plurality of pixels includes four sub-pixels which are different in color from each other and aligned in the first direction. Each of the plurality of image signal lines is connected alternately to the sub-pixels positioned on one side of the image signal line and the sub-pixels positioned on another side. The plurality of image signal lines have a unit array thereof composed of eight successive image signal lines. The drive circuit outputs, during one frame period, image signals having either one of positive polarity and negative polarity to first, third, fourth, and sixth image signal lines among the eight image signal lines of the unit array. The drive circuit outputs the image signals of another polarity to remaining image signal lines of the eight image signal lines.

According to the above embodiment, it is possible to prevent flicker and to prevent a common electrode potential from becoming different from a base potential, while preventing increase of power consumption.

The above general aspect may include one or more of the following features. Each of the plurality of pixels may include a red sub-pixel, a green sub-pixel, a blue sub-pixel, and a white sub-pixel as the four sub-pixels. A plurality of blue sub-pixels may be aligned in a direction along the plurality of image signal lines between the third image signal line and the fourth image signal line of the eight image signal lines and between the seventh image signal line and the eighth image signal line of the eight image signal lines. According to this embodiment, although there is a possibility that vertical stripes are caused in an image at a time of monochromatic display of blue, influence of the vertical stripes against the image quality can be small because the brightness of the color blue is relatively low, and thus an image of sufficient quality can be obtained.

Each of the plurality of pixels may include a red sub-pixel, a green sub-pixel, a blue sub-pixel, and a white sub-pixel as the four sub-pixels. A plurality of the red sub-pixels may be aligned in a direction along the plurality of image signal lines between the third image signal line and the fourth image signal line of the eight image signal lines and between the seventh image signal line and the eighth image signal line of the eight image signal lines. According to this embodiment, although there is a possibility that vertical stripes are caused in an image at a time of monochromatic display of red, influence of the vertical stripes against the image quality is small because the brightness of the color red is relatively low, and thus an image of sufficient quality can be obtained.

BRIEF DESCRIPTION OF THE DRAWINGS

FIG. 5 shows a polarity of each sub-pixel obtained when image signals in an even-number frame period shown in FIG. 4 are output to respective image signal lines:

FIG. 8 shows polarity of each sub-pixel obtained when image signals in an even-number frame period shown in FIG.

Figure 7:
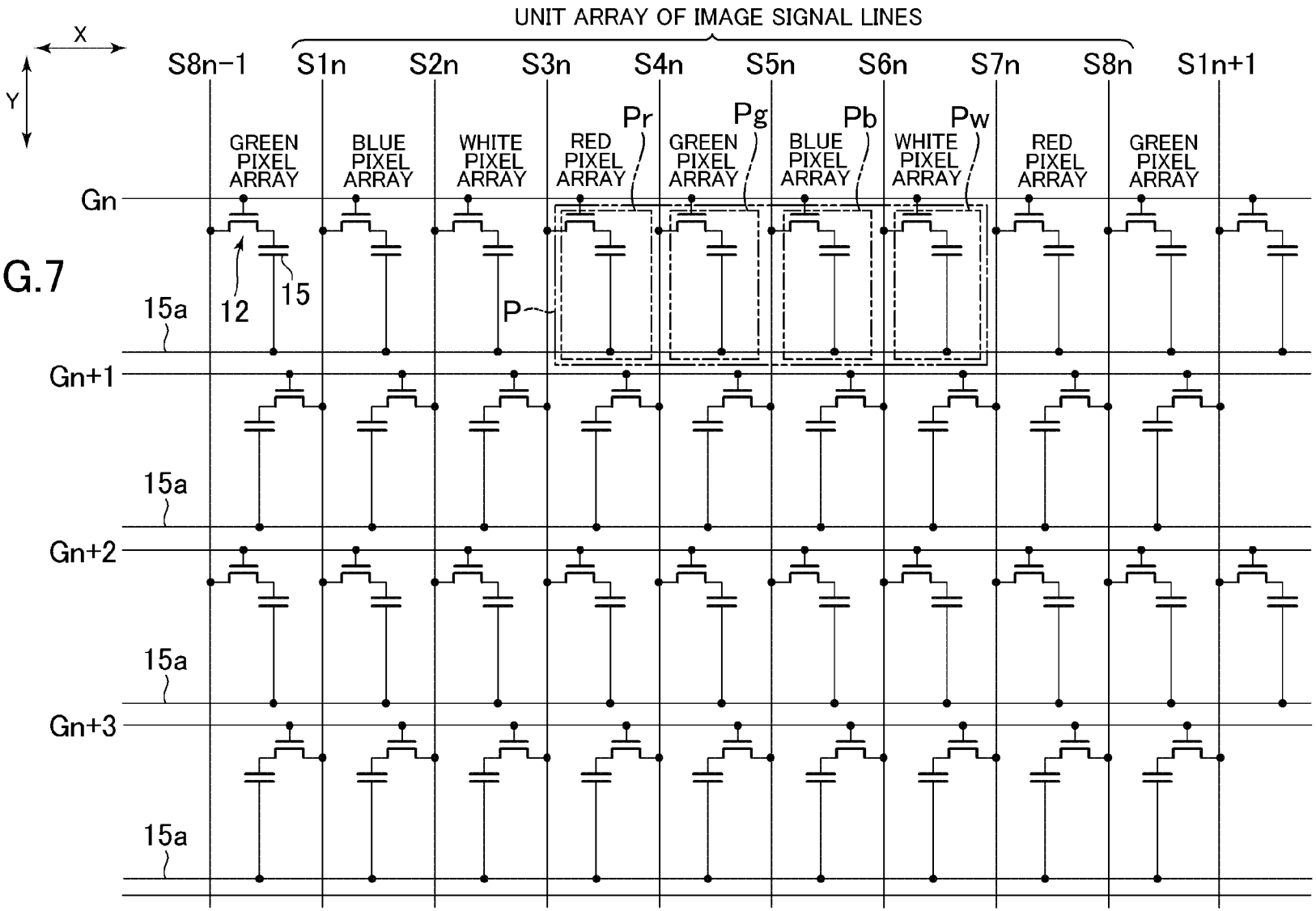
FIG. 7 schematically shows another example of a circuit formed on a TFT substrate that constitutes a liquid crystal display panel according to an embodiment of the present implementation.

4 are output to respective image signal lines in a liquid crystal display panel having the circuit shown in FIG. 7 formed thereon.

DETAILED DESCRIPTION

Figure 1:
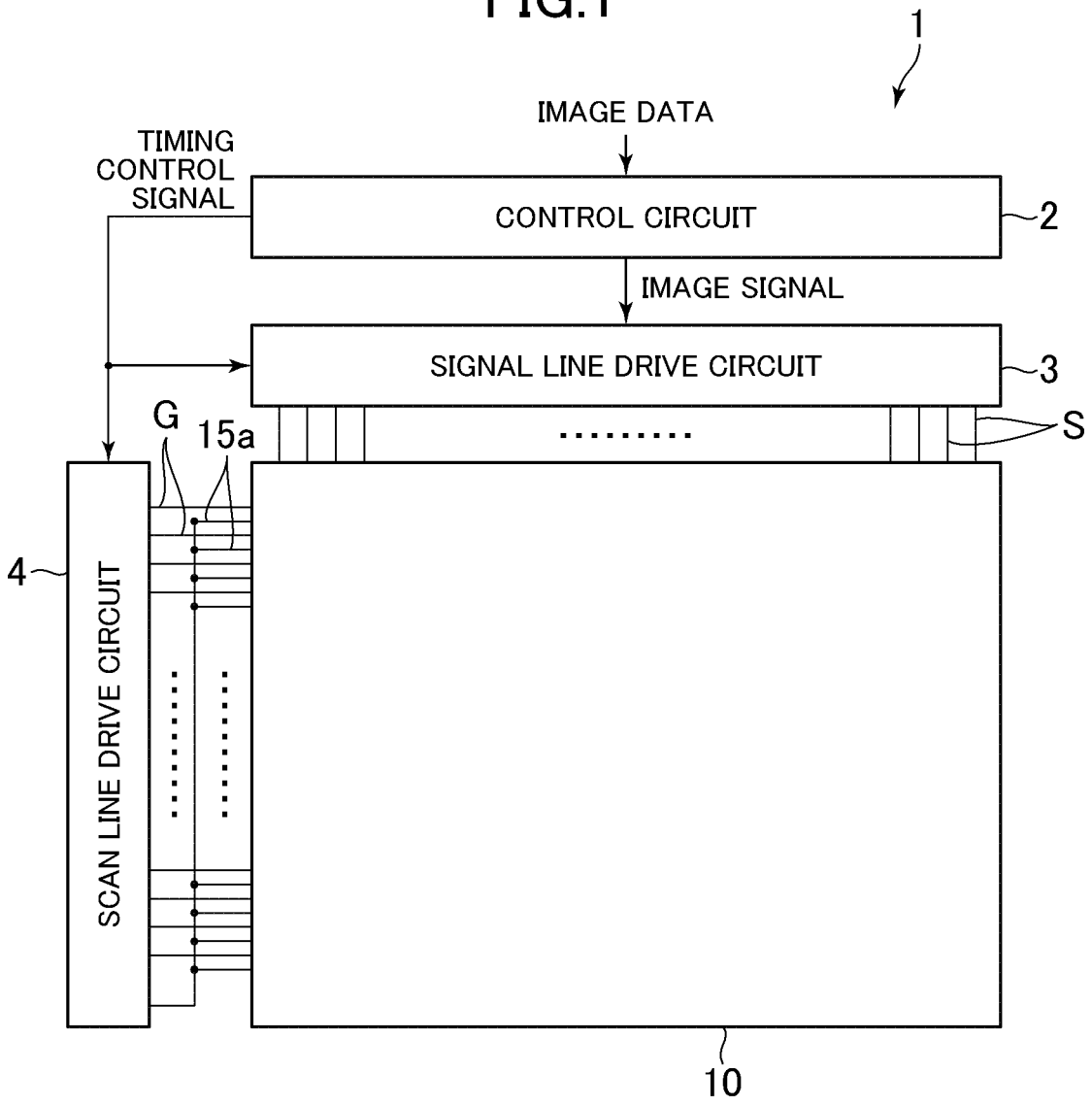
FIG. 1 schematically shows a structure of a liquid crystal display device according to an embodiment of the present implementation.

In the following, an embodiment of the present implementation will be described with reference to the accompanying drawings. FIG. 1 schematically shows a structure of a liquid crystal display device 1 according to an embodiment of the present implementation.

As shown in FIG. 1, the liquid crystal display device 1 includes a liquid crystal display panel 10, a control circuit 2, a signal line drive circuit 3, and a scan line drive circuit 4. The liquid crystal display device 1 additionally includes a backlight unit (not shown) for irradiating light to the liquid crystal display panel 10.

The liquid crystal display device 1 is, e.g., a display device of a television. The control circuit 2 obtains video data from an external device. The external device includes, e.g., a tuner, a video reproduction device for reproducing video data recorded in a recording medium, and so forth. The control circuit 2 generates a timing control signal, such as a horizontal synchronizing signal, a vertical synchronizing signal, based on the video data, and outputs the control signal to the signal line drive circuit 3 and the scan line drive circuit 4. Further, the control circuit 2 generates an image signal which represents a gradation value of each sub-pixel formed on the liquid crystal display panel 10, based on the video data obtained, and outputs the signal to the signal line drive circuit 3. Still further, the liquid crystal display panel 10 in this example includes a white sub-pixel in addition to red, green, blue sub-pixels, in each pixel, as to be described later in detail. The control circuit 2 generates an image signal which represents a gradation value of a white sub-pixel, based on the video data, and outputs the signal to the signal line drive circuit 3.

The liquid crystal display panel 10 includes two transparent substrates (e.g., glass substrates) facing each other. One of the substrates is a TFT substrate on which a TFT (a thin film transistor) 12 is formed, while the other is a color filter substrate on which a color filter is formed. A liquid crystal layer is formed between these two transparent substrates. The liquid crystal display panel 10 is driven in the IPS (In Plane Switching Mode) mode. However, the present implementation may be applied to various liquid crystal display panels driven in the TN mode (Twisted Nematic Mode), the VA mode (Vertical Alignment Mode), or the like.

Figure 2:
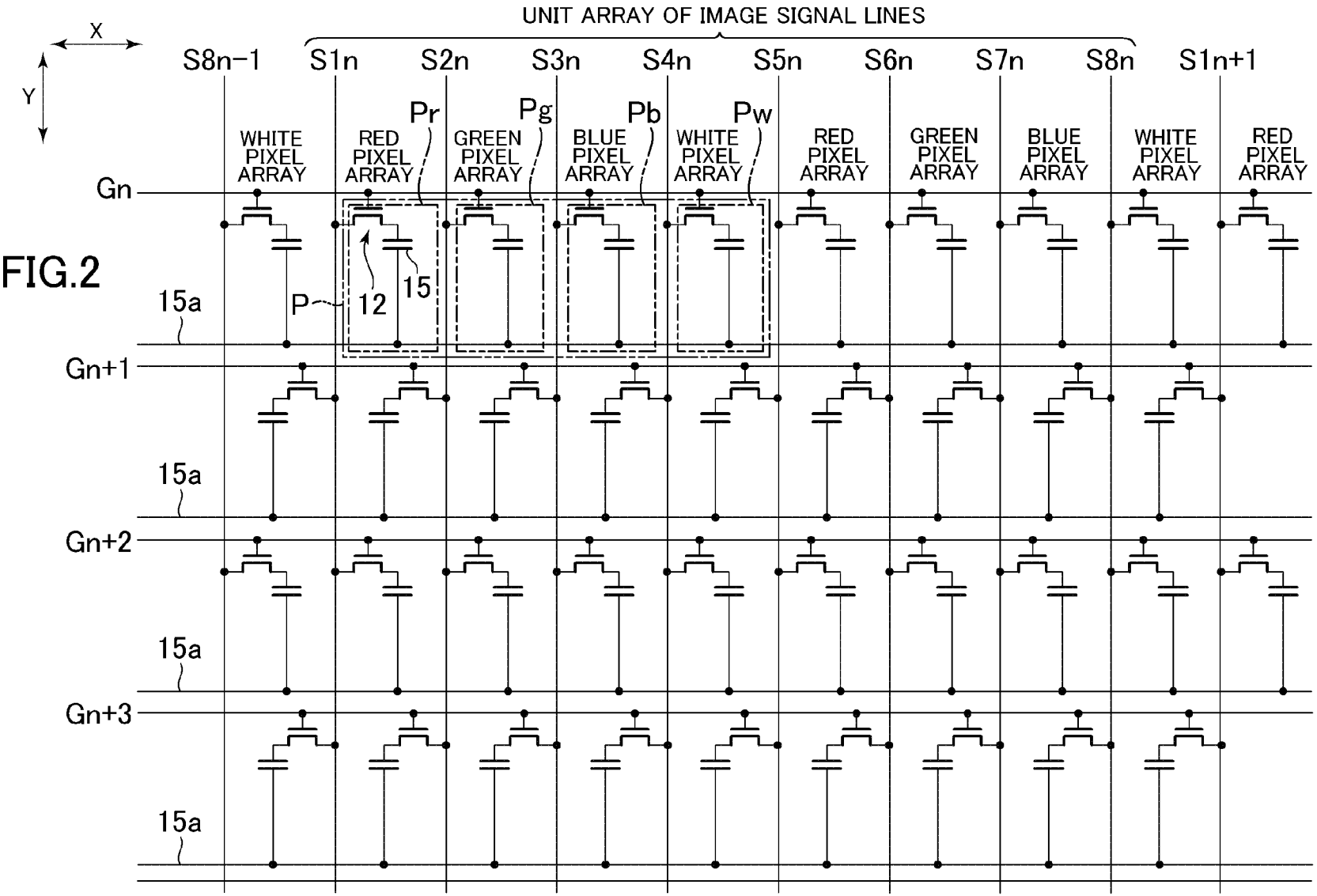
FIG. 2 schematically shows a circuit formed on a TFT substrate that constitutes a liquid crystal display panel of the liquid crystal display device.

FIG. 2 schematically shows a circuit formed on the TFT substrate. In FIG. 2, indexes 8n−1, 1n to 8n, 1n+1 are added to the reference letter S for an image signal line. Further, an index n is added to the reference letter G for a scan line. In the description below, the image signal lines S1*n* to S8*n*, shown in FIG. 2, will be mainly explained. The explanation on the image signal line S1*n* to S8*n* is similarly applied to image signal lines S1*n*−1 to S8*n*−1 constituting another unit array, and image signal lines S1*n*+1 to S8*n*+1 as well. In the following, simple terms "an image signal line S" and "a scan line G" will be used in explanations which are not directed to a particular image signal line, a particular scan line, and a particular sub-pixel color.

As shown in FIG. 2, a plurality of image signal lines S and a plurality of scan lines G are formed in a matrix on the TFT substrate. The plurality of image signal lines S are formed along the vertical direction Y with a constant interval in the horizontal direction X (a first direction in the claims). The plurality of scan lines G are formed along the horizontal direction X with a constant interval in the vertical direction Y. Each area defined by two adjacent image signal lines S and two adjacent scan lines G has a sub-pixel formed therein.

As shown in FIG. 1, the scan line G is connected to the scan line drive circuit 4. The scan line drive circuit 4 sequentially selects a scan line G in the vertical direction Y according to a timing control signal output from the control circuit 2, and outputs a scan signal (a gate voltage) to the selected scan line G. A sub-pixel (specifically, the TFT 12 of each sub-pixel) connected to the scan line G having received the scan signal is turned into the ON state. A period of time necessary for the scan line drive circuit 4 to select all of the scan lines G corresponds to one frame period.

As shown in FIG. 1, the image signal line S is connected to the signal line drive circuit 3. The signal line drive circuit 3 outputs an image signal (a voltage in accordance with a gradation value) which represents the gradation value of each sub-pixel to the image signal line S in synchronous with the selection of the scan line G by the scan line drive circuit 4. That is, the signal line drive circuit 3 inputs an image signal corresponding to the gradation value of a sub-pixel connected to the selected scan line G to the sub-pixel through the image signal line S.

As shown in FIG. 2, the liquid crystal display panel 10 includes a common electrode 15 facing the pixel electrode 11. The common electrode 15 includes a plurality of common electrode lines 15*a* formed along a direction intersecting the image signal line S, that is, the horizontal direction X. In the liquid crystal display panel 10 driven in the IPS mode, the common electrode 15 and the common electrode line 15*a* are formed on the TFT substrate. Meanwhile, when the liquid crystal display panel 10 is driven in the TN type mode or the VA mode, the common electrode 15 and the common electrode line 15*a* are formed on the color filter substrate. The common electrode line 15*a* is connected to an IC that constitutes the scan line drive circuit 4. The common electrode 15 receives a voltage through the common electrode line 15*a* such that the potential thereof (hereinafter referred to as a common electrode potential Vcom) becomes identical to a base potential.

As shown in FIG. 2, in the liquid crystal display panel 10 in this example, each pixel (a unit pixel) P includes four sub-pixels aligned in the horizontal direction X. The colors of the four sub-pixels are different from each other. Specifically, each pixel P includes a red sub-pixel Pr, a green sub-pixel Pg, a blue sub-pixel Pb, and a white sub-pixel Pw. The red sub-pixel Pr, the green sub-pixel Pg, the blue sub-pixel Pb, and the white sub-pixel Pw are aligned in the same order in all pixels. In this example, the red sub-pixel Pr, the green sub-pixel Pg, the blue sub-pixel Pb, and the white sub-pixel Pw are aligned in this order in the horizontal direction X. Meanwhile, sub-pixels of the same color are aligned in the vertical direction Y. In FIG. 2, for simplification, reference letters Pr, Pg, Pb, Pw are given to only sub-pixels constituting one pixel P.

The area on the color filter substrate corresponding to the white sub-pixel Pw has, e.g., a white color material formed thereon as a filter. Alternatively, the area corresponding to the white sub-pixel Pw may have an overcoat layer formed thereon covering the color filter substrate while not having the color material, and the overcoat layer may function as a filter for passing light through. Further, the area corresponding to the white sub-pixel Pw has color material, such as blue material or the like, partially formed in the area, and a white sub-pixel may be realized by light passing through the hole in the color material.

Figure 3:
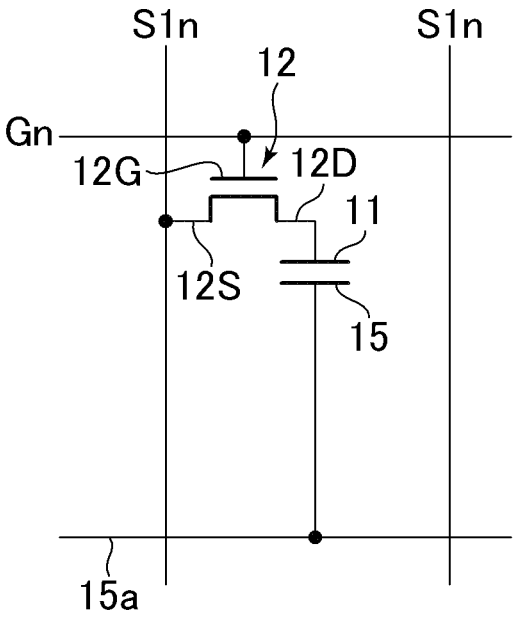
FIG. 3 is an enlarged view of FIG. 2.

FIG. 3 is an enlarged view of FIG. 2. As shown in FIG. 3, the TFT substrate has the pixel electrode 11 in each sub-pixel.

Further, the TFT substrate includes a TFT 12 in each sub-pixel, for functioning as a switch element for turning on/off electric conductivity between the pixel electrode 11 and the image signal line S. The TFT 12 includes a gate 12G connected to the scan line G, a source 12S connected to the image signal line S, and a drain 12D connected to the pixel electrode 11.

As shown in FIG. 2, each image signal line S is connected alternately to sub-pixels positioned on one side of the image signal line S (e.g., on the right side in FIG. 2) and sub-pixels positioned on the other side (e.g., on the left side in FIG. 2). In other words, one of two sub-pixels adjacent to each other in the vertical direction Y is connected to one of two image signal lines S that are respectively arranged on the both sides (right and left sides) of the two sub-pixels, and the other of the two sub-pixels is connected to the other image signal line S.

Referring to FIG. 2, the image signal line S1*n* is connected to red sub-pixels Pr positioned on the right side of the image signal line S1*n* and white sub-pixels Pw positioned on the left side of the image signal line S1*n* alternately in the vertical direction Y. Similarly, each of the other image signal lines S2*n* to S8*n* is alternately connected to sub-pixels positioned on one side of the respective image signal line S2*n* to S8*n* and to sub-pixels positioned on the other side. Note here that "an image signal line S is connected to a sub-pixel" means that "the image signal line S is connected to the source 12S of the TFT 12 of a sub-pixel".

The signal line drive circuit 3 described above outputs image signals to the plurality of image signal lines S in the frame reversal (frame inversion) driving mode. That is, the signal line drive circuit 3 reverses the polarity (positive polarity and negative polarity) of an image signal to be output to each image signal line S for every frame of image. The image signal having positive polarity has a voltage higher than a common electrode potential Vcom, and the image signal having negative polarity has a voltage lower than the common electrode potential Vcom.

The plurality of image signal lines S formed on the TFT substrate has, as a unit array thereof, an image signal line group composed of eight successive image signal lines S1*n* to S8*n*, as shown in FIG. 2. The unit arrays each composed of image signal lines S1*n* to S8*n* are aligned in the horizontal direction X. During one frame period, the signal line drive circuit 3 outputs image signals having one of the positive and negative polarities to the image signal lines S1*n*, S3*n*, S4*n*, S6*n* among the image signal lines S1*n* to S8*n*, and outputs image signals having the other polarity to the remaining image signal lines S2*n*, S5*n*, S7*n*, S8*n*. During each frame period, the signal line drive circuit 3 maintains the polarities of image signals to be output to the image signal lines S1*n*, S3*n*, S4*n*, S6*n* at one of the positive polarity and the negative polarity and maintains those to be output to the image signal lines S2*n*, S5*n*, S7*n*, S8*n* at the other polarity. With the above, it is possible to reduce an reversal frequency (inversion frequency) of the polarity of an image signal, and to reduce power consumption of the signal line drive circuit 3.

Figure 4:
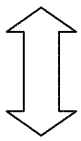
FIG. 4 shows polarities of image signals to be output to eight image signal lines constituting a unit array of image signal lines.

FIG. 4 shows an example of the polarities of image signals to be output to each image signal line S. In FIG. 4, positive polarity is provided with "+", while negative polarity is provided with "−". For example, as shown in this diagram, during an even-number frame period, the signal line drive circuit 3 outputs, e.g., image signals having positive polarity to the image signal lines S1*n*, S3*n*, S4*n*, S6*n* and image signals having negative polarity to the remaining image signal lines S2*n*, S5*n*, S7*n*, S8*n*. As describe above, the signal line drive circuit 3 outputs an image signal in a frame reversal driving mode. Thus, in the example shown in FIG. 4, during an odd-numbered frame period, the signal line drive circuit 3 outputs image signals having negative polarity to the image signal lines S1*n*, S3*n*, S4*n*, S6*n* and image signals having positive polarity to the remaining image signal lines S2*n*, S5*n*, S7*n*, S8*n*.

When the image signal polarity is defined as described above, it is possible to prevent flicker in image and to prevent the common electrode potential Vcom from becoming different from a base potential. This is described below referring to FIG. 5. FIG. 5 shows polarity of each sub-pixel obtained when image signals in an even-number frame period, shown in FIG. 4, are output to the image signal lines S1*n* to S8*n*. Note that the polarities in an odd-number frame period are opposite from those shown in FIG. 5 as to all sub-pixels. The polarity of a sub-pixel means polarity of the pixel electrode 11 included in the sub-pixel.

As described above, each image signal line S is connected alternately to the plurality of sub-pixels positioned on one side of the image signal line S and to the plurality of sub-pixels positioned on the other side. For example, the red sub-pixels Pr aligned in the vertical direction Y between the image signal lines S1*n* and S2*n* are alternately connected to the image signal line S1*n* and S2*n*. Therefore, the polarities of the red sub-pixels Pr between the image signal lines S1*n* and S2*n* are +, −, +, −, . . . , as shown in FIG. 5 during an even-number frame period. Meanwhile, the red sub-pixels Pr aligned in the vertical direction Y between the image signal lines S5*n* and S6*n* are alternately connected to the image signal lines S5*n* and S6*n*. Therefore, the polarities of the red sub-pixels Pr between the image signal lines S5*n* and S6*n* are −, +, −, +, . . . , as shown in FIG. 5 during the same even-number frame period. That is, focusing to the red sub-pixels Pr, sub-pixels having negative polarity and sub-pixels having positive polarity are alternately aligned in both of the horizontal direction X and the vertical direction Y. This is also applied to the green sub-pixel Pg and the white sub-pixel Pw. That is, focusing to the green sub-pixels Pg, negative polarity and positive polarity are alternately aligned in both of the horizontal direction X and the vertical direction Y. Moreover, focusing to the white sub-pixels Pw, negative polarity and positive polarity are alternately aligned in both of the horizontal direction X and the vertical direction Y. Therefore, it is possible to prevent flicker in image even at a time of monochromatic display of red or green or at a time when light is emitted from the white sub-pixel Pw (the potential of the pixel electrodes 11 of sub-pixels of other colors is the same as the base potential at the time of the monochromatic display). In addition, it is possible to prevent the average of potential of the sub-pixels in the horizontal direction X (the average of potentials of the pixel electrodes 11) from becoming significantly different from the base potential of the common electrode potential Vcom even at a time of monochromatic display of red or green and at a time when light is emitted from the white sub-pixel Pw, because positive and negative polarities are alternately aligned in the horizontal direction X. Consequently, it is possible to prevent the common electrode potential Vcom from becoming different from the base potential (that is, the potential difference between the common electrode potential Vcom and the pixel electrode 11 becomes smaller) due to the potential of the common electrode line 15*a* being affected by the potential of the pixel electrode 11. With the above, it is possible to prevent decrease of the brightness of the display surface.

As to the blue sub-pixel Pb, the polarities are arranged as follows. As shown in FIG. 2, blue sub-pixels Pb are aligned in the vertical direction Y between the image signal lines S3*n* and S4*n* which are positioned adjacent to each other and receive image signals having the same polarity, and between the image signal lines S7*n* and S8*n* which are positioned adjacent to each other and receive image signals having the same polarity. Since the polarities of image signals input to the image signal lines S3*n*, S4*n* differ from those of image signals input to the image signal lines S7*n*, S8*n* (see FIG. 4), the blue sub-pixels Pb aligned in the horizontal direction X alternately have positive and negative polarities, as shown in FIG. 5. Consequently, it is possible to prevent flicker in image. Moreover, even at a time of monochromatic display of blue, it is possible to prevent the average of potentials of the blue sub-pixels Pb aligned in the horizontal direction X from becoming different from the base potential of the common electrode potential Vcom, and to prevent the common electrode potential Vcom from becoming different from the base potential. Note that, focusing to the blue sub-pixels Pb aligned in the vertical direction Y, the polarities of all blue sub-pixels Pb are the same, being either negative or positive. Therefore, there is a possibility that vertical stripes are caused in a displayed image at a time of monochromatic display of blue. However, influence on the image quality is small because the brightness of the color blue is relative low, and an image of sufficient quality can be obtained.

Figure 6:
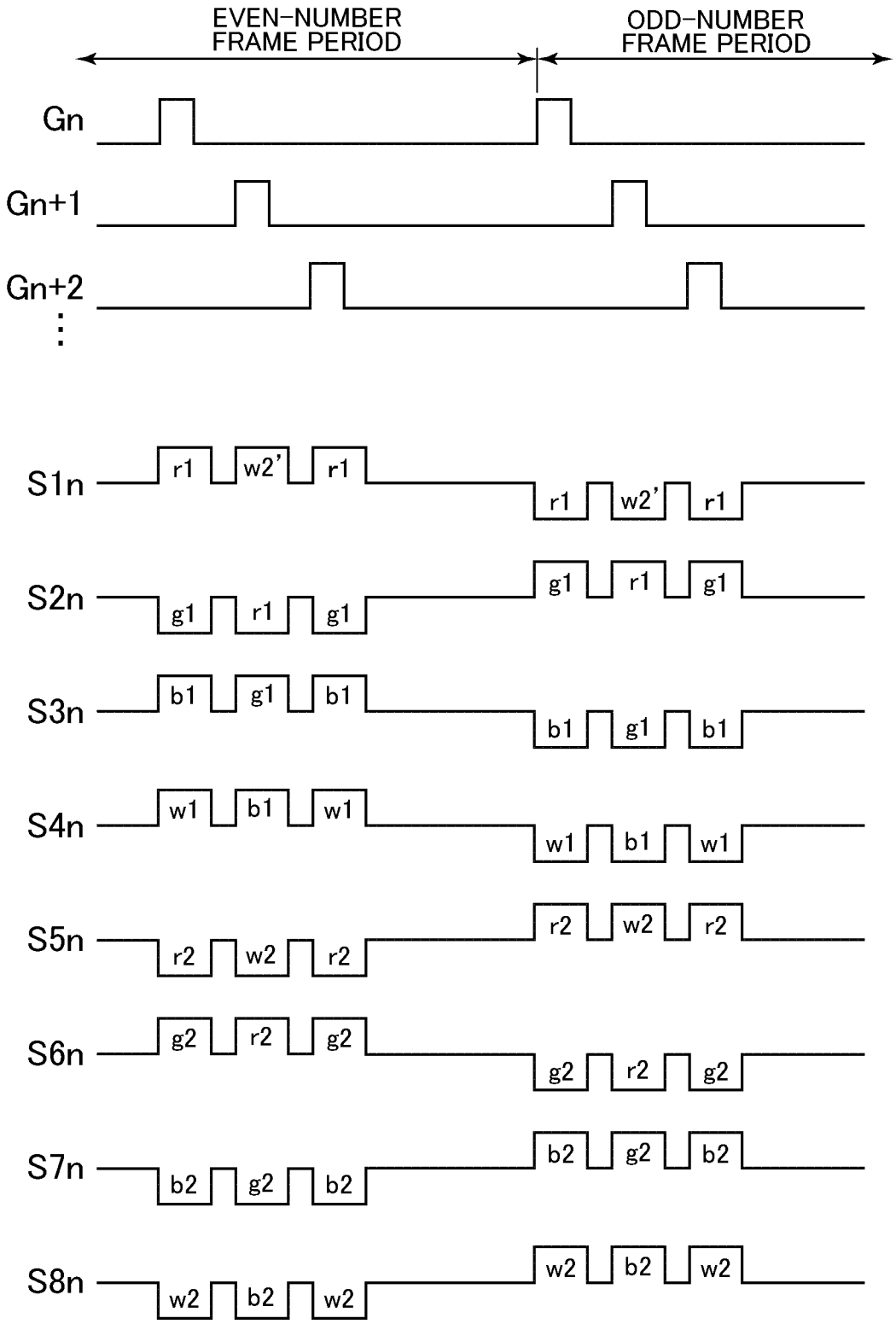
FIG. 6 is a time chart for explaining an operation of a signal line drive circuit and a scan line drive circuit.

FIG. 6 is a time chart for explaining an operation of the signal line drive circuit 3. In this diagram, an image signal representing a gradation value of the red sub-pixel Pr between the image signal lines S1*n* and S2*n* is indicated as r1, and an image signal representing a gradation value of the red sub-pixels Pr between the image signal lines S5*n* and S6*n* is indicated as r2. Similarly, image signals representing gradation values of the green, blue, and white sub-pixels are indicated as g1, g2, b1, b2, w1, w2, respectively. Further, an image signal representing a gradation value of the white sub-pixel Pw between the image signal line S1*n* and the eighth image signal line S8*n*−1 (see FIG. 2) that is a part of the next unit array is indicated as w2'.

During an even-number frame period, at a scan time for the scan line Gn, the signal line drive circuit 3 respectively outputs, to the image signal line S1*n* to S8*n*, image signals representing the gradation values of sub-pixels which are positioned on one side (on the right side in FIG. 2) of each image signal line S1*n* to S8*n* and connected to the scan line Gn. That is, at a time when a scan signal is output to the scan line Gn, the signal line drive circuit 3 respectively outputs, to the image signal lines S1*n* to S8*n*, image signals r1, g1, b1, w1, r2, g2, b2, w2 representing respectively gradation values of the sub-pixels Pr, Pg, Pb, Pw, Pr, Pg, Pb, Pw connected to the scan line Gn. Thereafter, at a scan time for the next scan line Gn+1, the signal line drive circuit 3 respectively outputs, to the respective image signal line S1*n* to S8*n*, image signals representing the gradation values of sub-pixels which are positioned on the other side (on the left side in FIG. 2) of each image signal line S1*n* to S8*n* and connected to the scan line Gn+1. That is, at a time at which a scan signal is output to the scan line Gn+1, the signal line drive circuit 3 respectively outputs, to the image signal lines S2*n* to S8*n*, image signals r1, g1, b1, w1, r2, g2, b2 representing respectively gradation values of the sub-pixels Pr, Pg, Pb, Pw, Pr, Pg, Pb connected to the scan line Gn+1. At the same time, an image signal w2' representing the gradation value of the white sub-pixels Pw connected to the scan line Gn+1 and positioned between the image signal lines S8*n*−1 and S1*n* is output to the image signal line S1*n*. Thereafter, at a scan time for the scan line Gn+2, the signal line drive circuit 3 respectively outputs, to the image signal line S1*n* to S8*n*, image signals representing the gradation values of sub-pixels which are positioned on one side of each image signal line S1*n* to S8*n* and connected to the scan line Gn+2. That is, during one frame period, the signal line drive circuit 3 inputs image signals alternately to sub-pixels positioned on one side of the image signal line S and sub-pixels positioned on the other side. The polarities of the image signals to be output to the image signal lines S1*n* to S8*n* are maintained as +, −, +, +, −, +, − during this even-number frame period. Therefore, it is possible to reduce reversal frequency of image signals and to prevent increase of power consumption.

As shown in FIG. 6, the polarities of image signals which the signal line drive circuit 3 outputs to the respective image signal lines S1*n* to S8*n* during an odd-number frame period are reversed from those during an even-number frame period. That is, the polarities of image signals which the signal line drive circuit 3 outputs to the respective image signal lines S1*n* to S8*n* are maintained as −, +, −, −, +, −, +, + during an odd-number frame period. An operation of the signal line drive circuit 3 during an odd-number frame period is similar to that during an even-number frame period in that the signal line drive circuit 3 inputs image signals alternately to sub-pixels positioned on one side of the image signal line S and sub-pixels positioned on the other side.

FIG. 7 schematically shows another example of a circuit formed on the TFT substrate according to an embodiment of the present implementation. In FIG. 7, a member same as that which has been described above is given an identical reference numeral/letter. In the following, only a difference from the example described above is described, and a matter without description thereon is the same as the example described above.

The example shown in FIG. 7 differs from the example described above in the positions of four sub-pixels Pr, Pg, Pb, Pw relative to the image signal lines S1*n* to S8*n*. That is, in this example, blue sub-pixels Pb are aligned in the vertical direction Y between the image signal lines S1*n* and S2*n* and between the image signal lines S5*n* and S6*n*. In this example as well, the sub-pixels Pr, Pg, Pb, Pw are repetitively aligned in this order in the horizontal direction X. Thus, a plurality of red sub-pixels Pr are aligned in the vertical direction Y between the image signal lines S3*n* and S4*n* and between the image signal lines S7*n* and S8*n*.

Even in the example in which the positions of the sub-pixels Pr, Pg, Pb, Pp relative to the image signal lines S1*n* to S8*n* are as shown in FIG. 7, by making the polarities of image signals to be output to the respective image signal lines S1*n* to S8*n* similar to those shown in FIG. 4, it is possible to prevent flicker in image and to prevent the common electrode potential Vcom from becoming different from the base potential. In the following, the above will be described with reference to an example shown in FIG. 8. FIG. 8 shows the polarity of each sub-pixel obtained when image signals for an even-number frame period, shown in FIG. 4, are respectively output to the image signal lines S in the liquid crystal display panel having the circuit shown in FIG. 7 formed thereon.

As shown in FIG. 7, the blue sub-pixels Pb aligned in the vertical direction between the image signal lines S1*n* and S2*n* are alternately connected to the image signal lines S1*n* and S2*n*. Therefore, the polarities of the blue sub-pixels Pb between the image signal lines S1*n* and S2*n* are +, −, +, −, . . . , as shown in FIG. 8. The blue sub-pixels Pb aligned in the vertical direction between the image signal lines S5*n* and S6*n* are alternately connected to the image signal lines S5*n* and S6*n*, as shown in FIG. 7. Therefore, the polarities of the blue sub-pixels Pr between the image signal lines S5*n* and S6*n* are −, +, −, +, . . . , as shown in FIG. 8. That is, focusing to the blue sub-pixels Pb, negative polarity and positive polarity are alternately aligned in both of the horizontal direction X and the vertical direction Y. This is also applied to the green sub-pixel Pg and the white sub-pixel Pw. That is, focusing to the green sub-pixel Pg, positive polarity and negative polarity are alternately aligned in both of the horizontal direction X and the vertical direction Y. Further, focusing to the white sub-pixel Pw, positive polarity and negative polarity are alternately aligned in both of the horizontal direction X and the vertical direction Y. Therefore, it is possible to prevent flicker in image even at a time of monochromatic display of blue or green or at a time when light is emitted from the white sub-pixel Pw. In addition, it is possible to prevent the average of potentials of the sub-pixels in the horizontal direction X from becoming remarkably different from the base potential of the common electrode potential Vcom even at a time of monochromatic display of blue or green or at a time when light is emitted from the white sub-pixel Pw, because positive polarity and negative polarity are alternately aligned in the horizontal direction X. Consequently, it is possible to prevent the common electrode potential Vcom from becoming different from the base potential due to the potential of the common electrode line 15*a* being affected by the potential of the pixel electrode 11. With the above, it is possible to prevent decrease of the brightness of the display surface.

As to the red sub-pixel Pr, the polarities are arranged as follows. As shown in FIG. 7, the red sub-pixels Pr are aligned in the vertical direction Y between the image signal line S3*n* and S4*n* which are positioned adjacent to each other and receive image signals having the same polarity, and between image signal lines S7*n* and S8*n* which are positioned adjacent to each other and receive image signals having the same polarity. The polarity of the image signals input to the image signal lines S3*n*, S4*n* differs from that of the image signals input to the image signal lines S7*n*, S8*n* (see FIG. 4). Therefore, the red sub-pixels Pr aligned in the horizontal direction X alternately have positive polarity and negative polarity, as shown in FIG. 8. As a result, it is possible to prevent flicker in image. Further, since it is possible to prevent the average of potential of the red sub-pixels Pr aligned in the horizontal direction X from becoming different from the base potential even at a time of monochromatic display of red, the common electrode potential Vcom can be prevented from becoming different from the base potential. Note that, focusing to the red sub-pixels Pr aligned in the vertical direction Y, the polarities of all red sub-pixels Pr are the same, being either negative or positive. Therefore, even though there is a possibility that vertical stripes are caused in a displayed image at a time of monochromatic display of red, influence on image quality is small since the brightness of red is relatively low, similar to blue, and thus image of sufficient quality can be obtained.

Below, an operation executed by the signal line drive circuit 3 will be described. In this example similar to the example described referring to FIG. 6, at a scan time for the scan line Gn in an even-number frame period, the signal line drive circuit 3 respectively outputs, to the image signal line S1*n* to S8*n*, image signals representing the gradation values of sub-pixels which are positioned on one side (on the right side in FIG. 7) of each image signal line S1*n* to S8*n* and connected to the scan line Gn. That is, when a scan signal is output to the scan lien Gn, the signal line drive circuit 3 respectively outputs, to the image signal lines S1*n* to S8*n*, image signals representing the gradation values of the respective sub-pixels Pb, Pw, Pr, Pg, Pb, Pw, Pr, Pg connected to the scan line Gn. Thereafter, at a scan time for the next scan line Gn+1, the signal line drive circuit 3 respectively outputs, to the image signal line S1*n* to S8*n*, image signals representing the gradation values of the sub-pixels which are positioned on the other side (on the left side in FIG. 7) of the respective image signal line S1*n* to S8*n* and connected to the scan line Gn+1. At the same time, an image signal representing the gradation value of the green sub-pixel Pg connected to the scan line Gn+1 and positioned between the image signal lines S8*n*−1 and S1*n* is output to the image signal line S1*n*. Specifically, during one frame period, the signal line drive circuit 3 outputs image signals alternately to sub-pixels positioned on one side of the image signal line S and to sub-pixels positioned on the other side. The polarities of the image signals to be output to the respective image signal lines S1*n* to S8*n* are maintained as +, −, +, +, −, +, −, − during this even-number frame period. Meanwhile, the polarities of image signals which the signal line drive circuit 3 outputs to the image signal lines S1*n* to S8*n* during an odd-number frame period are reversed from those during an even-number frame period. That is, the polarities of the image signals which the signal line drive circuit 3 outputs to the respective image signal lines S1*n* to S8*n* are maintained as −, +, −, −, +, −, +, + during an odd-number frame period. An operation of the signal line drive circuit 3 during an odd-number frame period is similar to that during an even-number frame period in that the signal line drive circuit 3 inputs image signals alternately to sub-pixels positioned on one side of the image signal line S and to sub-pixels positioned on one the other side.

As described above, each of the plurality of image signal lines S is alternately connected to the plurality of sub-pixels positioned on one side of the image signal line S and those on the other side. During one frame period, the signal line drive circuit 3 outputs image signals having either one of the positive and negative polarities to the first, third, fourth, and sixth image signal lines S1*n*, S3*n*, S4*n*, S6*n* of the eight image signal lines S1*n* to S8*n* that constitute a unit array, and the signal line drive circuit 3 outputs image signals having the other polarity to the remaining image signal lines S2*n*, S5*n*, S7*n*, S8*n*. Thus, it is possible to prevent flicker in image and to prevent the common electrode potential Vcom from becoming different from the base potential, while reducing reversal frequency of the polarity of an image signal.

In the example shown in FIG. 2, the blue sub-pixels Pb are aligned in the vertical direction Y between the image signal lines S3*n* and S4*n* which are positioned adjacent to each other and receive image signals having the same polarity, and between image signal lines S7*n* and line S8*n* which are positioned adjacent to each other and receive image signals having the same polarity. Thus, focusing to the blue sub-pixels Pb aligned in the vertical direction, the polarities of all blue sub-pixels Pb are the same, being either negative or positive. However, since the brightness of blue is relatively low, influence on image quality is small, and an image of sufficient quality can be obtained.

In the example shown in FIG. 7, the plurality of red sub-pixels Pr are aligned in the vertical direction Y between the image signal lines S3*n* and S4*n* which are positioned adjacent to each other and receive image signals having the same polarity and between the image signal lines S7*n* and S8*n* which are positioned adjacent to each other and receive image signals having the same polarity. Thus, focusing to the red sub-pixels Pr aligned in the vertical direction, the polarities of all red sub-pixels Pr are the same, being either negative or positive. However, since the brightness of red is relatively low, similar to blue, influence on image quality is small, and thus an image of sufficient quality can be obtained.

Note that the present implementation is not limited to the above described embodiments, and various modifications are possible.

For example, although the red sub-pixel Pr, the green sub-pixel Pg, the blue sub-pixel Pb, and the white sub-pixel Pw are aligned in this order in each pixel in the description above, the order of alignment of the sub-pixels is not limited to the above described. For example, in the example shown in FIG. 2, the positions of the red sub-pixel Pr and the green sub-pixel Pg may be exchanged. In the example shown in FIG. 7, the positions of the blue sub-pixel Pb and the white sub-pixel Pw may be exchanged.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A liquid crystal display device, comprising:

a liquid crystal display panel including a plurality of scan lines and a plurality of image signal lines formed, thereon in a matrix, and a plurality of pixels each including a plurality of sub-pixels, each sub-pixel being formed in an area defined by two adjacent image signal lines and two adjacent scan lines; and a drive circuit which outputs an image signal to the plurality of image signal lines in a frame reversal driving mode, wherein:

the plurality of image signal lines are aligned in a first direction, each of the plurality of pixels includes four sub-pixels which are different in color from each other and aligned in the first direction, each of the plurality of image signal lines is connected alternately to the sub-pixels positioned on one side of the image signal line and the sub-pixels positioned on another side, the plurality of image signal lines have a unit array thereof composed of eight successive image signal lines, the drive circuit outputs, during one frame period, image signals having either one of positive polarity and negative polarity to first, third, fourth, and sixth image signal lines among the eight image signal lines of the unit array, and image signals of another polarity to remaining image signal lines among the eight image signal lines, each of the plurality of pixels includes a red sub-pixel, a green sub-pixel, a blue sub-pixel, and a white sub-pixel as the four sub-pixels, a plurality of red sub-pixels are aligned in a direction along the plurality of image signal lines between the third image signal line and the fourth image signal line of the eight image signal lines and between the seventh image signal line and the eighth image signal line of the eight image signal lines, and each of red sub-pixels in a direction along each of image signal lines has the same polarity during each frame period.

* * * * *